United States Patent [19]

Walter

[11] Patent Number: 4,977,831

[45] Date of Patent: Dec. 18, 1990

[54] SYSTEM AND METHOD FOR ZONAL FOUNTAIN CONTROL IN A PRINTING PRESS

[75] Inventor: Claus Walter, Glauburg, Fed. Rep. of Germany

[73] Assignee: Man Roland Druckmaschinen AG, Offenbach am Main, Fed. Rep. of Germany

[21] Appl. No.: 388,150

[22] Filed: Aug. 1, 1989

[30] Foreign Application Priority Data

Aug. 8, 1988 [DE] Fed. Rep. of Germany ..... 3826383

[51] Int. Cl.[5] ..... B41F 31/02

[52] U.S. Cl. ..... 101/365; 101/DIG. 47

[58] Field of Search ..... 101/DIG. 47, DIG. 45, 101/365; 364/519

[56] References Cited

U.S. PATENT DOCUMENTS 4,508,034 4/1985 Bolza-Schünemann .... 101/DIG. 47

FOREIGN PATENT DOCUMENTS 3220378 12/1983 Fed. Rep. of Germany ..... 101/365

2073665 10/1981 United Kingdom ..... 101/DIG. 47

*Primary Examiner*—Clifford D. Crowder

*Attorney, Agent, or Firm*—Leydig, Voit & Mayer

[57] ABSTRACT

A system and a method for making fountain adjustments in a printing press. A press control panel has a plurality of key pairs for bidirectionally controlling associated fountain adjusters, and the system provides for zonal adjustment by defining zones which include a plurality of fountain adjusters and simultaneously adjusting all of the adjusters in a defined zone. A zone definition begins by detection of simultaneous actuation of both keys in a pair, and a zone is defined by actuation of a further key, the zone encompassing all adjusters lying between the actuated key pair and the further key. After definition of a zone, all of the adjusters in a zone are controlled by operation of one or two keys in the zone. Flexibility is provided to adjust all adjusters in the same direction and by the same amount, or to interpolate adjustments between adjusters.

24 Claims, 5 Drawing Sheets

SYSTEM AND METHOD FOR ZONAL FOUNTAIN CONTROL IN A PRINTING PRESS

FIELD OF THE INVENTION

This invention relates to printing presses and more particularly to a system and method for zonal control of fountain adjustments in a printing press.

BACKGROUND OF THE INVENTION

A conventional rotary printing press has fountains for applying printing fluids to the press rollers, printing plates, and ultimately to the sheet or web being printed. Separate fountains are usually provided for ink and for water for each printing couple. Usually adjusters such as servomotors are provided across each fountain for controlling the ink or water supply provided by that fountain in incremental zones or columns across the fountain. By way of definition for purposes of this disclosure, in order to avoid confusion between the increment of the fountain controlled by a single adjuster and the larger increment controlled by a contiguous group of adjusters, the former will be referred to as a single or individual zone, and the term "zone", when used on its own is intended to refer to a plurality of contiguous single zones (i.e., a composite zone).

Control panels are associated with printing presses and have, among other control elements, an array of keys, such as mechanical switches or pushbuttons, for controlling the fountain adjusters. The keys are usually arranged in pairs (increase and decrease for each adjuster) in an elongated row, with the spacing between the keys often the same as the adjuster spacing across the fountain. By depressing a particular increase or decrease ink or water adjusting key, the position of the associated adjuster in the fountain is altered to supply more or less ink or water to the portion of the printed sheet controlled by the adjuster in question. Usually, such control panels also have a pair of ALL keys (one for each direction) which will adjust all of the adjusters in a selected fountain in the direction associated with the actuated ALL key.

European patent specification 0 047 926 discloses a system for inhibiting fountain adjusters in rotary presses wherein a microcomputer is programmed to respond to operation of a format selector key followed by operation of a "less ink" key in a selected inking unit to cause the ink adjusters, usually servomotors, to move into the neutral position with respect to the ink ductor and to stop. In the neutral position, the single zone associated with that adjuster supplies no ink to its area of the press. Until the "stop" instruction is cancelled, i.e., until the format selector key is actuated again, the adjusters in the deactivated single zones are inaccessible either for individual or joint ink zone adjustments, i.e., they are completely inactive until the stop instruction is cancelled.

The use of additional keys, such as the format keys described in connection with the aforementioned European patent specification, further complicates the control panel. Not only does the use of further specialized keys increase the complexity of the task presented to the pressman and make his job more difficult, but such specialized keys take up additional space on the control panel and require additional production and assembly costs. In addition, this known system of format selection is of limited flexibility since all that it is capable of doing is to inhibit (i.e., render inoperative) the fountain adjusters which ar deactivated.

SUMMARY OF THE INVENTION

In view of the foregoing, it is a general aim of the present invention to provide a system for controlling fountain adjustments in a printing press which requires no separate format selector or zone selector key, but which facilitates composite zone selection and adjustment using the normal fountain adjustment keys.

In that regard, it is an object of the present invention to provide a system for controlling fountain adjustments in which the normal fountain adjustment keys operate in a first mode to operate the associated adjusters, and operate in a second mode for zone selection and definition, and following definition of a zone can be used to alter all of the adjusters within the defined zone.

It is a feature of the invention to take advantage of the fact that ink adjustment keys are disposed in pairs for bidirectional operation of the associated adjuster, and to respond to simultaneous or near-simultaneous actuation of both keys in a pair to initiate a zone selection operation, and then to respond to actuation of a further key for defining zone boundaries. Upon definition of the boundaries of a zone, all of the adjusters within that zone can be operated simultaneously by depression of one or a very limited number of keys in the zone.

In accordance with the invention, there is provided a system (and a corresponding method) for controlling fountain adjustments in a printing press, in which the press has a plurality of adjusters disposed along the fountain for making incremental adjustments, and the control panel has a plurality of key pairs related to the respective adjusters for bidirectional control thereof. Zone selection mean are provided for detecting actuation within a predetermined time interval of both keys in a pair, and as a result of that detection, for initiating a zone selection operation. Zone definition means are active during the zone selection operation for detecting the actuation of a further key. Upon detection of actuation of that further key, the zone definition means defines zone boundaries which correspond to the actuated key pair on the one side, and the further key on the other. Zone adjustment means is then responsive to actuation of at least one key in the zone for adjusting all of the adjusters in the defined zone. Thus, zone adjustments can be carried out without the necessity for additional zone definition keys, the standard adjustment keys being all that is needed to provide both individual and zonal adjustments.

Other objects and advantages will become apparent from the following detailed description when taken in conjunction with the drawings, in which:

Figure 1:
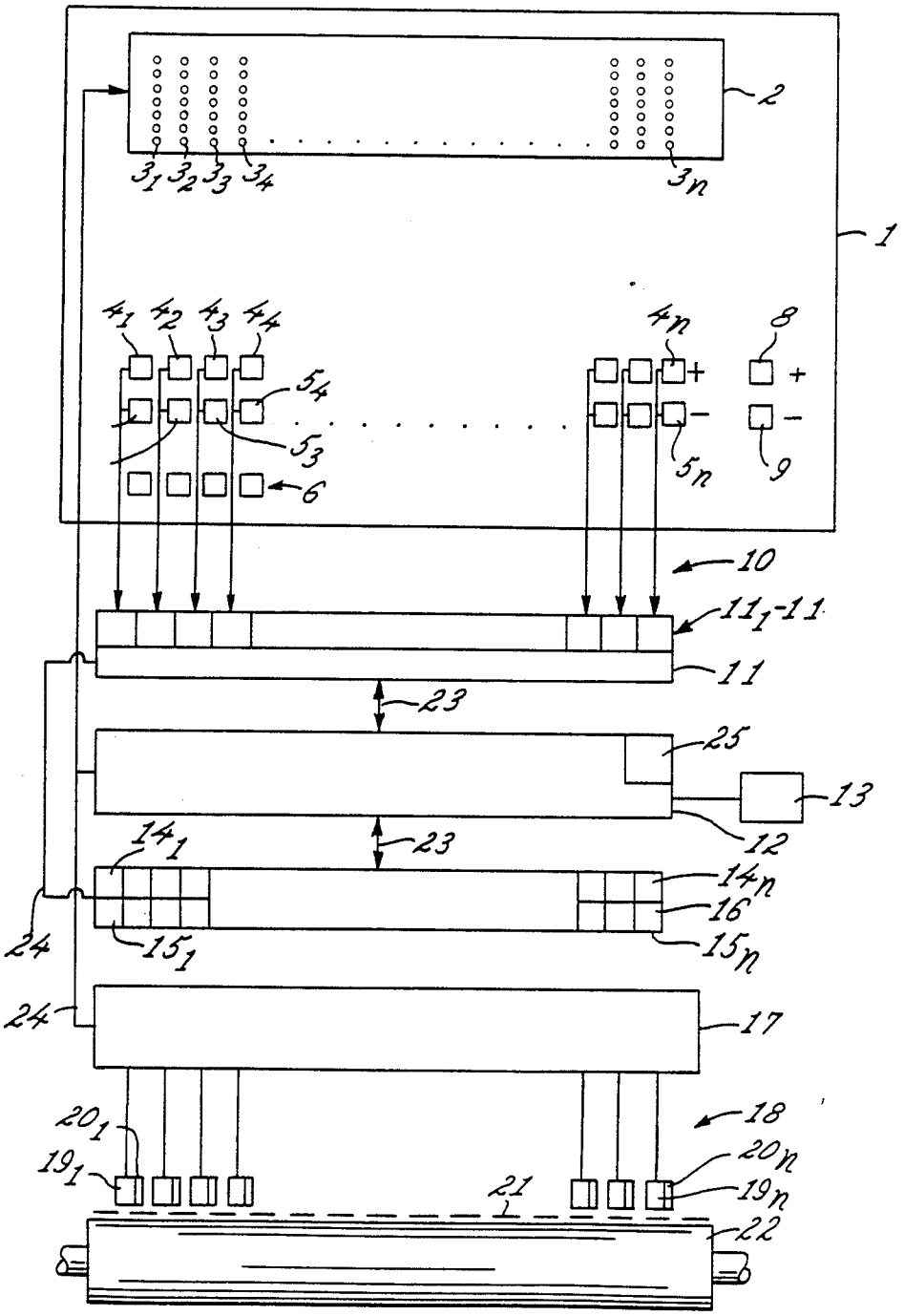
FIG. 1 is a diagrammatic view illustrating a control panel, ink fountain, and fountain control system exemplifying the present invention.

While the invention will be described in connection with certain preferred embodiments, there is no intent to limit it to those embodiments. On the contrary, the intent is to cover all alternatives, modifications and equivalents included within the spirit and scope of the invention as defined by the appended claims.

DESCRIPTION OF THE PREFERRED EMBODIMENTS

Selection systems according to the present invention are particularly suitable for use in offset rotary presses, including both sheet fed and reel or web fed presses. As diagrammatically illustrated in FIG. 1, the system comprises a control panel 1 having an ink zone display comprised, for example, of an array of diode rows $3_1$-$3_n$, each row being related to a single zone or fountain adjuster. It will be appreciated, of course, that display units other than LED arrays can be used, and in certain applications it may be preferable to utilize, for example, a CRT display for showing the position of each of the adjusters in the associated ink or water fountain. In any event, the positions of the ink adjusters or dampener control elements for the respective zones of the associated fountain are displayed in the zone display 2. In the illustrated embodiment, the LED illuminated in any of the rows, such as row $3_2$, displays the associated position of the ink adjuster in the fountain corresponding to that single zone. Thus, the LED or LED's illuminated in each of the rows across the display 2 will show the overall condition of the fountain adjustment.

The other most apparent significant feature of the control panel 1 is an array of adjustment keys arranged in two elongated rows, preferably corresponding spatially with the rows of diodes in the display 2. The keys are arranged in a pair of rows $4_1$-$4_n$ and $5_1$-$5_n$, with the rows being spaced closely adjacent to form key pairs, such as $4_1$ and $5_1$ to allow bidirectional control of an ink or dampener adjuster assigned to that key pair. It is typical to space the keys along the row at intervals which correspond to the size of the ink adjusters such that the printed sheet can be placed upon the control panel and the key positions will have a spatial relationship to the zones on the printed page which they control. Typically, the top row of keys $4_1$-$4_n$ will be assigned to increase the amount of ink or water by the associated adjuster whereas the corresponding key in the row $5_1$-$5_n$ will decrease the same function.

A printing press usually has a number of inking units, and when a plurality of units are controlled from a single panel, selector keys 6 are provided for individually selecting the unit which is to be adjusted. The selector keys 6 can also be used to select between the ink or dampener adjustments on a given printing unit. For the sake of conveniently adjusting all of the keys in a selected fountain an ALL increase key 8 and an ALL decrease key 9 are provided; depression of such key adjusts all of the adjusters associated with the selected fountain in the desired direction. The ALL keys 8, 9 can be wired to all of the corresponding increase $4_1$-$4_n$ or decrease $5_1$-$5_n$ keys or alternatively can be individually wired to the controlling electronics, as desired.

Turning from the control portion of the apparatus, i.e., the control panel 1, to the controlled portion, i.e., the fountain itself, there is shown at the lower portion of FIG. 1 an ink ductor roller 22 and a plurality of ink adjusters 21 spaced incrementally along the ductor roller. The adjusters 21 can be moved closer to the ductor roller 22 to reduced the thickness of the ink film carried by the ductor and thus the amount of ink applied to the associated area of the printed sheet, or can be moved farther from the ductor roller to apply a thicker ink film. A single adjuster 21 or the printed strip of the sheet which it controls is sometimes referred to herein as a "column"; that term is intended to refer to the strip of the sheet being controlled (or the adjuster which controls it) rather than the column divisions provided for in the layout of any printed sheet.

The positions of the adjusters 21 are controlled by associated bidirectional electric calculators $19_1$-$19_n$, which can be in the form of servomotors, stepper motors, electrical solenoids (particularly rotary solenoids), or the like. In particular applications, it is useful to associate feedback means $20_1$-$20_n$ with the respective electrical adjusters $19_1$-$19_n$ for providing position information for each ink adjuster to the control circuitry. Such position information is also used for illuminating particular ones of the diodes $3_1$-$3_n$ in the display portion 2 of the control panel 1. Instead of individual adjusters 21, a continuous ductor blade can be utilized as is well known in the art. FIG. 1 is also intended to illustrate by the controlled arrangement the fact that a dampener fountain can also be controlled. The details of the mechanism of the dampener are less important than the fact that individual electrical actuators such as $19_1$-$19_n$ are provided and associated with adjusters 21 for controlling on an incremental basis along the fountain the amount of dampener fluid applied to the press.

In accordance with the invention, a particular form of control circuitry is interposed between the control panel 1 and the controlled fountain in order to provide not only the standard functions of control keys $4_1$-$4_n$, $5_1$-$5_n$ directly operating associated fountain adjuster $21_1$-$20_n$, respectively, but also composite zonal adjustment for a plurality of adjusters which are controlled by a predetermined sequence of operation of the same incremental zone control keys $4_1$-$4_n$, $5_1$-$5_n$. To that end, the fountain adjustment keys $4_1$-$4_n$, $5_1$-$5_n$ are connected by means of conductors 10 to associated key recognitions circuitry 11. The circuit arrangement 11 includes key state memories $11_1$-$11n$, one for each of the key pairs, the key state memories being adapted to store the operative state of the associated keys $4_1$-$4_n$, $5_1$-$5_n$ In practicing the invention, there is associated with the key recognition circuitry 11 a zone recognition circuit arrangement 12 adapted to flexibly group individual zones associated with the individual key pairs into a larger composite zone for simplified control. A zone display 13 is conveniently associated with the zone recognition circuit 12. The zone display, while shown adjacent the circuit arrangement 12 in FIG. 1, is conveniently located on the control panel 1, preferably near the ink zone display 2 to facilitate ready association of an adjusted or selected composite zone with the individual ink zones.

The system of FIG. 1 also includes a counter unit 16 which is connected to the circuit arrangement 12, and has individual counters $14_1$-$14_n$ and $15_1$-$15_n$, one of the counters being associated with each of the keys $4_1$-$4_n$ and $5_1$-$5_n$, respectively. Alternatively, a reduced number of counters 14, 15 can be provided and can be multiplexed among the keys $4_1$-$4_n$, $5_1$-$5_n$ as the keys are actuated.

It is seen in FIG. 1 that the key state memory circuit 11 is coupled by way of bidirectional bus 23 to the zone recognition circuit 12, and the zone recognition circuit 12 is coupled by a further bidirectional bus 23 to the counter circuitry 16 such that those elements can function together in making ink and water adjustments. In addition, a bus 24 interconnects zone recognition circuit 12 and a motor control circuit 17 for allowing individual and group control of the electrical actuators $19_1$-$19_n$ in response to signals generated in the control circuitry. Also for the sake of completeness, it is noted that a further bus 24 couples the key state memory circuit 11 to the timer circuitry 16 so that the timers can be initiated upon actuation of a particular key, and tested for status upon further key actuation or when otherwise necessary.

Turning then to the motor control circuitry 17, it is seen that a series of electrical connections 18 are provided as outputs from the motor control circuit 17 to individual ones of the electrical adjusters $19_1$-$19_n$. It will thus be appreciated that the motor control circuitry includes the necessary power drivers (be they electronic or relay drivers) for providing power of the appropriate sense, polarity and duration to energize or de-energize the electrical actuators $19_1$-$19_n$ for achieving the desired degree of control over the mechanical adjustment mechanisms 21. The operation of the illustrated circuit in the normal mode need not be described in detail, since it is a conventional two-keys per directional actuator direct linkage system. Similarly, the position feedback sensors $20_1$-$20_n$ are connected by means not shown through the control circuitry to the display panel 2, so as to provide a visual indication of the actual position of the adjuster in the fountain.

In accordance with the invention, the same elements normally used for individual one key pair per one adjustment type operation are also utilized for selectable zonal adjustments. To that end, each time one of the keys $4_1$-$4_n$ or $5_1$-$5_n$ is depressed, in addition to making the correction normally associated with that key, means are provided for sensing whether a zone selection operation should be initiated. Such means, in the FIG. 1 embodiment, include the aforementioned countercircuitry 16. It is seen that the key recognition circuit 11 is coupled by means of bus 24 to the countercircuitry 16, and thus it will be appreciated that an associated counter is initiated upon actuation of any given key. If a second key actuator is detected during the initiated time interval, the possibility is present for the initiation of a zone selection operation.

Figure 2:
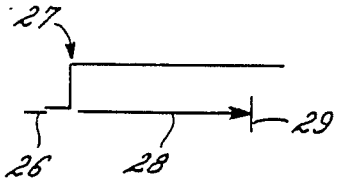
FIG. 2 is a timing diagram illustrating an ink key actuator and timing signal initiated thereby.

In the preferred practice of the invention, the second key which initiates the zone selection operation must occur not only during the predetermined interval, but the key must also be in the same key pair which had initiated the predetermined time interval. Thus, for example, if the key $4_3$ had been depressed, the timer $14_3$ would have initiated the timing interval and if, during that interval, the key $5_3$ were depressed, that would be sensed by the control circuitry, and a zone selection operation initiated. FIG. 2 illustrates a typical waveform which is associated with actuation of one of the keys 4, 5, and has a first portion 26 corresponding to the interval when the key is physically actuated, a rising edge 27 at the point the key is released and a high portion following release. In the example illustrated in FIG. 2, a time interval is initiated with the rising edge 27 and terminates a predetermined time later (such as 0.1 seconds later) at 29. Detection of a double key depression during a short predetermined interval such as described here is sometimes referred to in this specification as simultaneous or near-simultaneous actuation. If the second key is depressed at any time before the point 29, a double key actuation will be detected and will serve to initiate a zone select operation. It will be apparent that the timing interval can be initiated upon depression of the switch, after a switch actuation and an interval for debounce of the switch contacts or the like, FIG. 2 simply illustrating a currently preferred implementation.

Upon detection of a double key actuation, signalling that both keys in a pair have been operated within the predetermined interval, the zone selection operation is initiated. Preferably, initiation of a zone selection operation also operates upon counters 14, 15 to initiate a second predetermined interval for detection of a further key actuation which will result in definition of the zone boundaries. The key state memories 11 are also operational during this phase of zone control, and during the predetermined interval, continually monitor the keyboard array for actuation of the further key. If such actuation is detected, an appropriate signal is stored in the associated key state memory $11_1$-$11n$, a signal is passed along bus 24 to sample the appropriate timers 16 to assure that the key actuation has been sensed within the appropriate time interval, and signals are passed along bus 23 to the zone recognition circuitry to establish the boundaries of the zone. In a preferred practice of the invention, one of the zone boundaries is taken as the location corresponding to the key pair which had initiated the zone selection operation, and the other boundary of the zone is taken as the location corresponding to the further key which had been actuated during the predetermined interval to complete the zone definition operation. In the alternative, it can be required that a second key pair be "simultaneously" activated in order to define the second boundary of the zone in a fashion similar to that which had been required to initiate the zone selection operation. More particularly, the second keys can be activated either simultaneously or within a predetermined interval established by the timing circuitry 16.

A zone memory 25 is provided within the zone recognition circuitry 12 and is adapted to store the locations of the defined zone. Such locations can be stored simply as the addresses or locations of the two individual zones which define the boundaries of the composite zone, or the addresses or locations or all of the individual zones within the composite zone. In any event, the locations within the zone memory 25 serve to define the zone and its boundaries, and the location of the defined zone can be displayed to an operator by means of a zone display 13, preferably located on the operating panel 1. The operator thus has the opportunity, after defining the zone, to reassure himself that the zone is properly defined by viewing the display 13 and assuring that all of the individual ink zones he desired to be within the composite zone have indeed been included.

Figure 5:
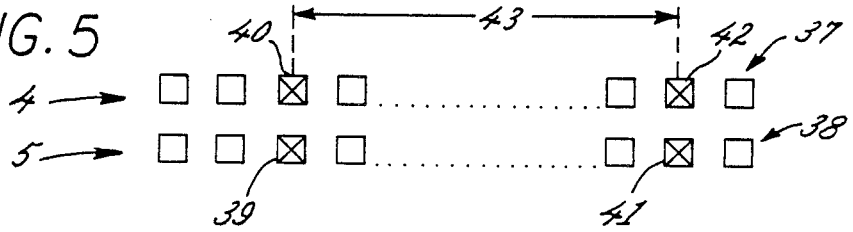
FIG. 5 is a diagram showing a double row of ink keys and a zone definition therein.
Figure 6:
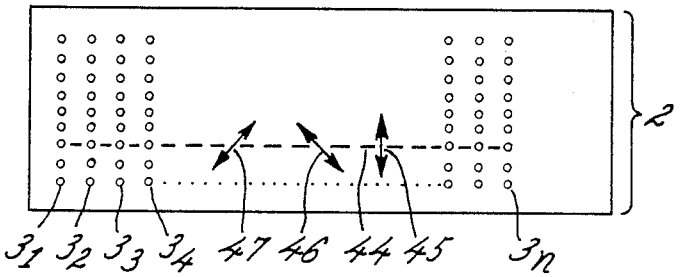
FIGS. 6 and 7 further illustrate the ink adjustment displays of the control panel of FIG. 1 and the types of fountain adjustment available in accordance with the present invention.
Figure 7:
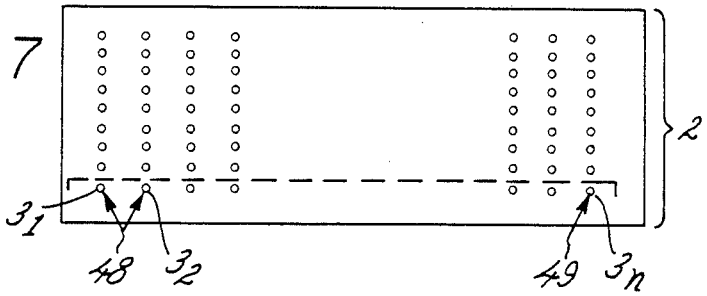

Having thus initiated a zone selection operation and defined the boundaries of the zone, the operator is then in a position to adjust all of the individual zones within the composite zone by operation of only one or a very few of the same control keys 4, 5. Exemplary types of adjustments which are available are best understood with reference to FIGS. 5–7. FIG. 5 shows a portion of the control panel 1, more particularly the array of key pairs 4, 5 while FIGS. 6 and 7 show the display portion 2; such figures will be used in describing zone selection, zone definition and zone adjustment operations available in accordance with the present invention.

First of all, it is recalled that a zone selection operation begins by simultaneous or near-simultaneous depression of both keys in a pair. Referring to FIG. 5, if the keys 39 and 40 are depressed within a predetermined time interval of each other, a zone selection operation will be initiated by the apparatus of FIG. 1. During the second predetermined time interval following initiation of the zone selection operation, if a further key such as key 41 or 42 is depressed, a zone definition operation will be performed. Assuming that key 41 is depressed, the control system of FIG. 1 will determine that a zone 43 has been defined having as its leftmost boundary the adjuster associated with keys 39, 40 and as its rightmost boundary the adjuster associated with keys 41, 42. It will be recalled that such a zone will, in addition to being defined and stored within the memory location 25 in the zone recognition circuitry 12, will also be displayed on zone display 13 so that the operator is assured that the appropriate zone has been defined.

Having thus defined the zone, the operator can then make a number of adjustments within the zone by depression of one or a very small number of keys within the zone. Assuming it is desired to increase the ink or water level applied throughout the zone, the operator will depress increase keys 40 and 42 at the respective zone ends, and that will result in operating all of the electrical actuators within the zone 43 to advance all of the keys at the same rate and by the same amount for as long as the keys 40 and 42 are depressed. That operation is illustrated in FIG. 6 by the vertical arrow 45 which suggests that all of the adjusters within the zone 43 are advanced. It will be also be appreciated that the adjusters will be adjusted from their position beginning at the start of the adjustment, rather than being leveled for adjustment together. Similarly, if it is desired to decrease all of the adjusters in the zone 43 by the same amount, the keys 39, 41 are simultaneously activated and will result in a decrease operation illustrated by the downwardly pointing portion of the arrow 45.

It is also possible to interpolate between adjusters in the zone. One form of such interpolation is by two key operation in which one decrease and one increase key are depressed and the adjusters intermediate those corresponding to the depressed keys will be interpolated in amount and direction depending upon their positional relationship to the depressed keys. For example, if decrease key 39 and increase key 42 are simultaneously depressed, the adjuster corresponding to key 42 will be increased while the adjuster corresponding with key 39 will be decreased for so long as the keys remain depressed. All of the intermediate adjusters will be increased or decreased by a smaller amount in dependence on their positional correspondence to the end adjusters, the circuitry of FIG. 1 serving to produce the interpolation and corresponding adjustment. The interpolated rotational adjustments are illustrated by the inclined arrows 46 and 47 of FIG. 6. As a final exemplary alternative, it is possible to interpolate from zero at one end of the defined zone to a positive or negative increase at the other end by depression of a single key. For example, if only key 41 in the defined zone is depressed, the adjuster corresponding to key 41 will be decreased for so long as the key remains depressed, the adjuster corresponding to keys 39 and 40 will be left in its last-adjusted position, and all of the intermediate adjusters will be adjusted in the negative direction by amounts interpolated between zero at the adjuster which is leftmost in the zone and maximum for the key at the rightmost boundary of the zone.

A further option available with the system according to the present invention is the disablement of one or more adjusters. Such disablement is preferably accomplished by simultaneous actuation of both keys in a pair (an event normally taken as the initiation of a zone selection operation) but not followed within the predetermined time interval by actuation of the further key which would normally result in a zone definition. Referring to FIG. 5, for example, if it were desired to deactivate the adjuster corresponding to keys 37, 38, such keys would be depressed simultaneously (i.e., within a predetermined interval of each other as set by the timer circuitry 16), and no further key would be depressed within the second time interval (the time interval allowed for a zone definition operation). If that second time interval expires, the control circuitry of FIG. 1 responds to that state of affairs by deactivating the adjuster associated with keys 37, 38 such that no ink is applied to the ductor roller in that zone. Referring to FIG. 7, it will be seen that the area 49 of the display 2 can be associated with the ink keys 37, 38 and all of the indicators in the row 49 can be blanked to illustrate that the associated adjuster is disabled and no ink is being applied in that zone. Similarly, when a narrow sheet is being printed, the zones associated with the indicators in the rows 48 can also be disabled by either double key operations as just described, or by a zone definition operation following which a zone adjustment operation to reduce the ink supply in all of the zones to a zero or disabled level.

The invention provides means for cancelling a zone which is as simple to operate as that for defining a zone. As a first example, a zone cancellation operation is allowed which is identical to the zone selection and zone definition operation, i.e., actuation of both keys in a pair (at one boundary of a defined zone) within a predetermined time interval followed by actuation of a further key which defines the rightmost boundary of the zone to be deactivated. Alternatively, in a simplified format, after a zone has been defined and it is desired to deactivate that zone, the system of FIG. 1 responds to a simultaneous actuation of both keys in a pair at one of the zone boundaries to deactivate the zone. Referring to FIG. 5, and assuming the zone 43 has previously been defined, such zone can be deactivated by simultaneous activation of keys 41, 42 within a predetermined time interval of each other.

According to an advantageous feature of the invention, the key recognition signals (i.e., the signals recognized in circuitry 11 and stored in the key recognition circuitry $\mathbf{11}_1$-$\mathbf{11}n$) are evaluated only when the operated keys have been released. Detection of the keys in conjunction with the timer circuitry 16, which has timers corresponding to the keys activated upon depression of a key, facilitates reliable operation or key recognition. More particularly, it is virtually impossible to operate two adjacent keys (i.e., both keys in a pair) in different key rows 4, 5 exactly simultaneously to initiate the zone selection. Consequently, the recognition circuitry 12, operating in conjunction with timer circuitry 16, establishes the predetermined interval for detecting zone selection or zone definition by an operator in a reliable fashion.

It was noted above that individual operation of any given key allows for direct adjustment of the associated adjuster. Thus, when using the system for zone selection, unless a time delay is introduced between key actuation and adjuster movement, one or more of the adjusters will be moved from their initial position during the course of zone selection and zone definition. To that end, the key recognition circuitry 11 operates in conjunction with the motor control circuitry 17 to return any keys adjusted during zone selection or zone definition to their original position prior to a zone adjustment operation.

Figure 3:
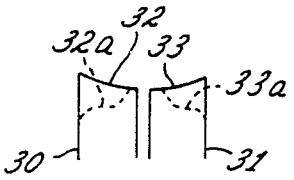
FIG. 3 is a diagram illustrating configurations for ink adjustment keys in a pair.
Figure 4:
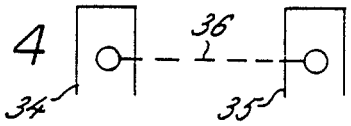
FIG. 4 is a similar diagram illustrating a bridge for associating ink keys in a pair.

In order to facilitate the operations of zone selection and zone definition, the rows of keys are closely juxtaposed, with keys in each pair reasonably close to each other, and the keys are preferably contoured so that both keys in a pair can be simultaneously actuated by a single finger. One form of such contoured keys is illustrated in FIG. 3 in which adjacent keys 30, 31 have beveled or semicircular recessed portions 32, 33, contoured for simultaneous actuation by a single finger. An alternative contour is illustrated at 32*a*, 33*a* in which the keys are contoured to have juxtaposed raised portions which allow for actuation of both keys by pressure applied by a single finger. FIG. 4 illustrates yet a further embodiment where the keys 34, 35 are separated by a greater distance than those in FIG. 3, but a mechanical or electrical bridge means 36 is utilized to allow the operator to simultaneously (or near simultaneously) depress both keys in a pair when a zonal operation is desired.

The embodiment of FIG. 1 was illustrated in connection with a hard-wired controller for responding to key actuations on the control panel 1 to provide either single actuator adjustment in the normal mode or zonal adjustment in the zonal mode. The hard-wired configuration can be constructed in the normal manner utilizing the appropriate buffers connected to the keys, drivers connected to the actuators and intermediate logic gates, registers, counters and the like for performing the functions described in detail above. As an alternative, a microprocessor with associated program memory can be configured to perform similar functions. Such an embodiment is illustrated in FIG. 8 in which the control panel 1 and adjusters $\mathbf{19}_1$-$\mathbf{19}_n$ are the same as illustrated in FIG. 1, but the intermediate control circuitry is based on a microprocessor rather than hard-wire logic.

Figure 8:
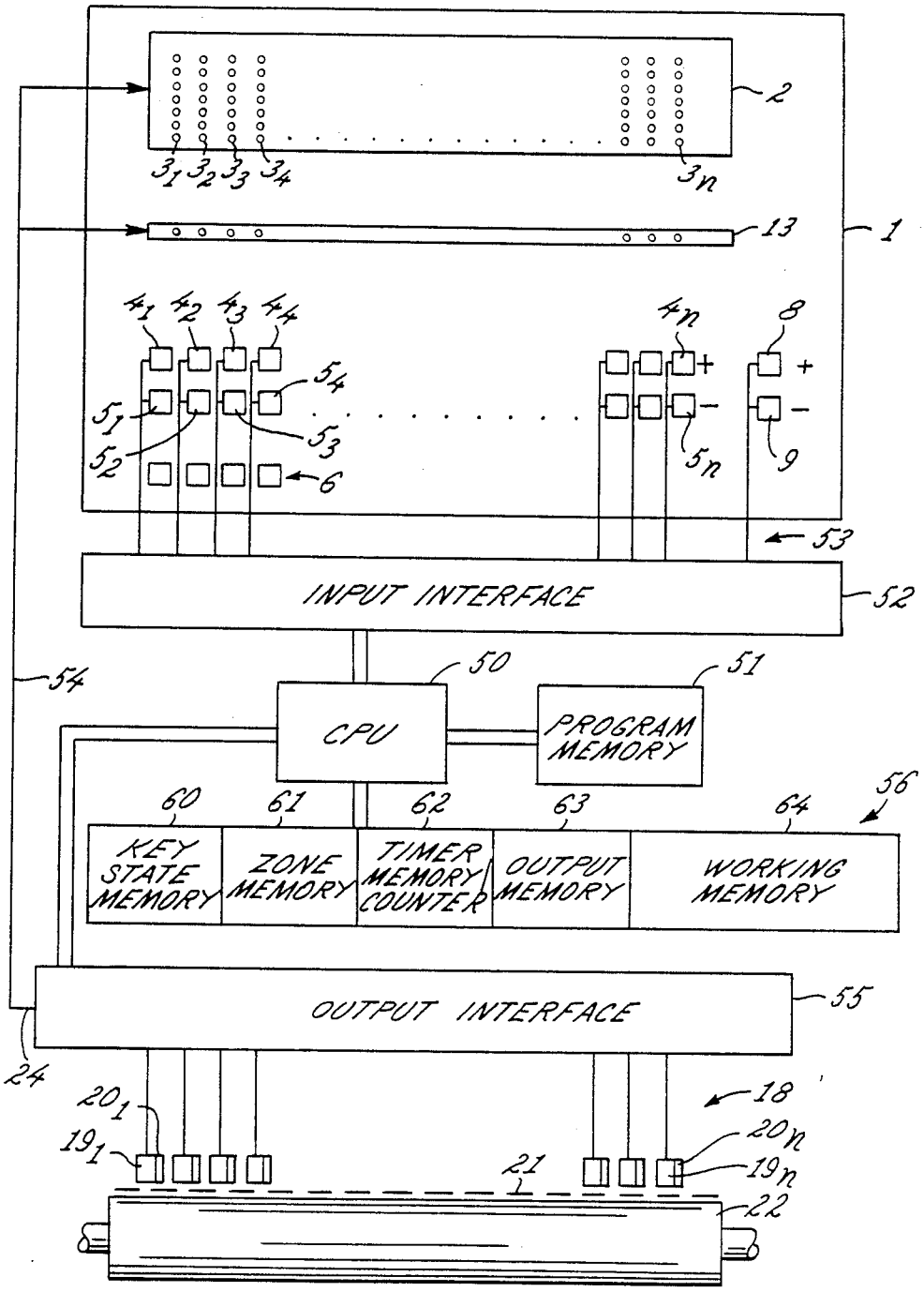
FIG. 8 is a diagram similar to FIG. 1 but illustrating an alternative form of the invention.

To that end, the FIG. 8 embodiment includes a microprocessor or CPU 50 which functions in conjunction with a program memory 51 for performing the steps described in detail above. An input interface 52 is coupled to the control panel switches by means of bus 53 and serves the standard interfacing functions of switch debouncing and logic translation for providing signals coupled to the microprocessor-based controller under the control of CPU 50. Also connected to the CPU bus is an output interface 55 which couples signals produced by the CPU 50 to the controllers $\mathbf{19}_1/\mathbf{19}_n$ for individual control of ink or water adjustments in the respective fountains. The output interface also has a connection 54 to the control panel 1 for driving the display unit 2 as well as the zonal display unit 13. The zonal display unit 13 is illustrated in FIG. 8 as disposed just below the status display 2 and is of the same size such that the lighted condition of LED's within zonal display 13 gives a graphic representation to the operator of the individual zones of the printing press which are included in the defined composite zone.

The exemplary embodiment of FIG. 8 is illustrated with a random access or read/write memory 56 which is divided into a number of sections. A first section is designated key state memory 60 and corresponds to the key recognition circuitry and key state memory circuitry 11 of FIG. 1. A zone memory 61 is also provided, and operating in conjunction with CPU 50, performs the functions of the zone recognition circuitry 12 of FIG. 1. Similarly, a timer memory/counter section 62 of the memory 56 causes the CPU 50 to perform the functions of countercircuitry 16 of FIG. 1. An output memory section 63 of the FIG. 8 embodiment contains an array of bits representing the on or off condition of the individual ones of the adjusters $\mathbf{19}_1$-$\mathbf{19}_n$ and thus corresponds in part to the motor control circuitry 17 of FIG. 1. The drivers, however, of the motor control circuitry 17 of FIG. 1 are contained in the output interface 55 when the invention is configured as illustrated in FIG. 7.8 A final section of memory 64 is designated "working memory" and simply relates to intermediate storage which the processor 50 can read or write in performing the various functions assigned to it.

Figure 9A:
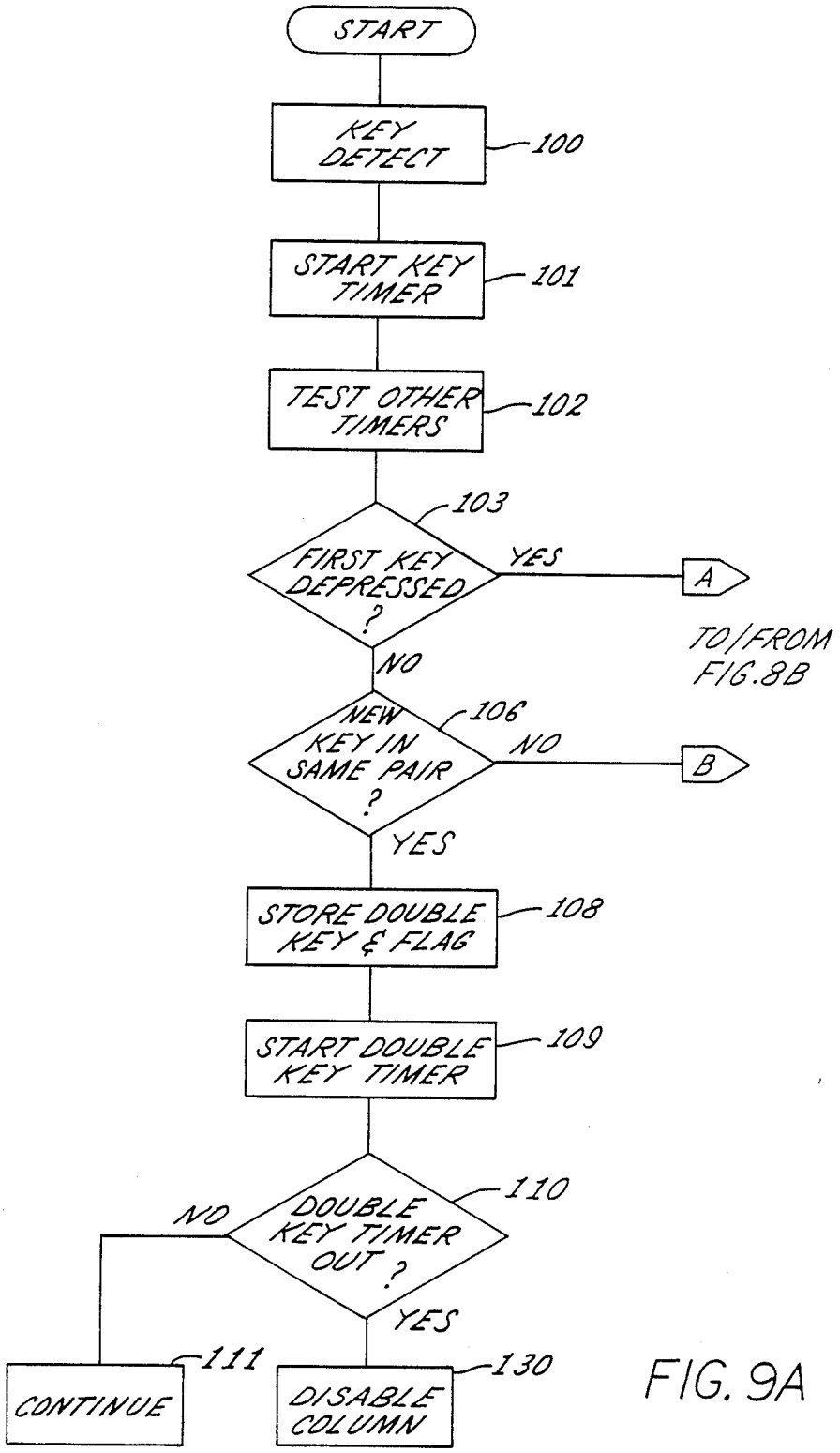
FIGS. 9A and 9B together form is a flowchart illustrating a sequence of steps operable in connection with the FIG. 1 or FIG. 8 embodiments for performing zonal ink adjustments in accordance with the present invention.
Figure 9B:
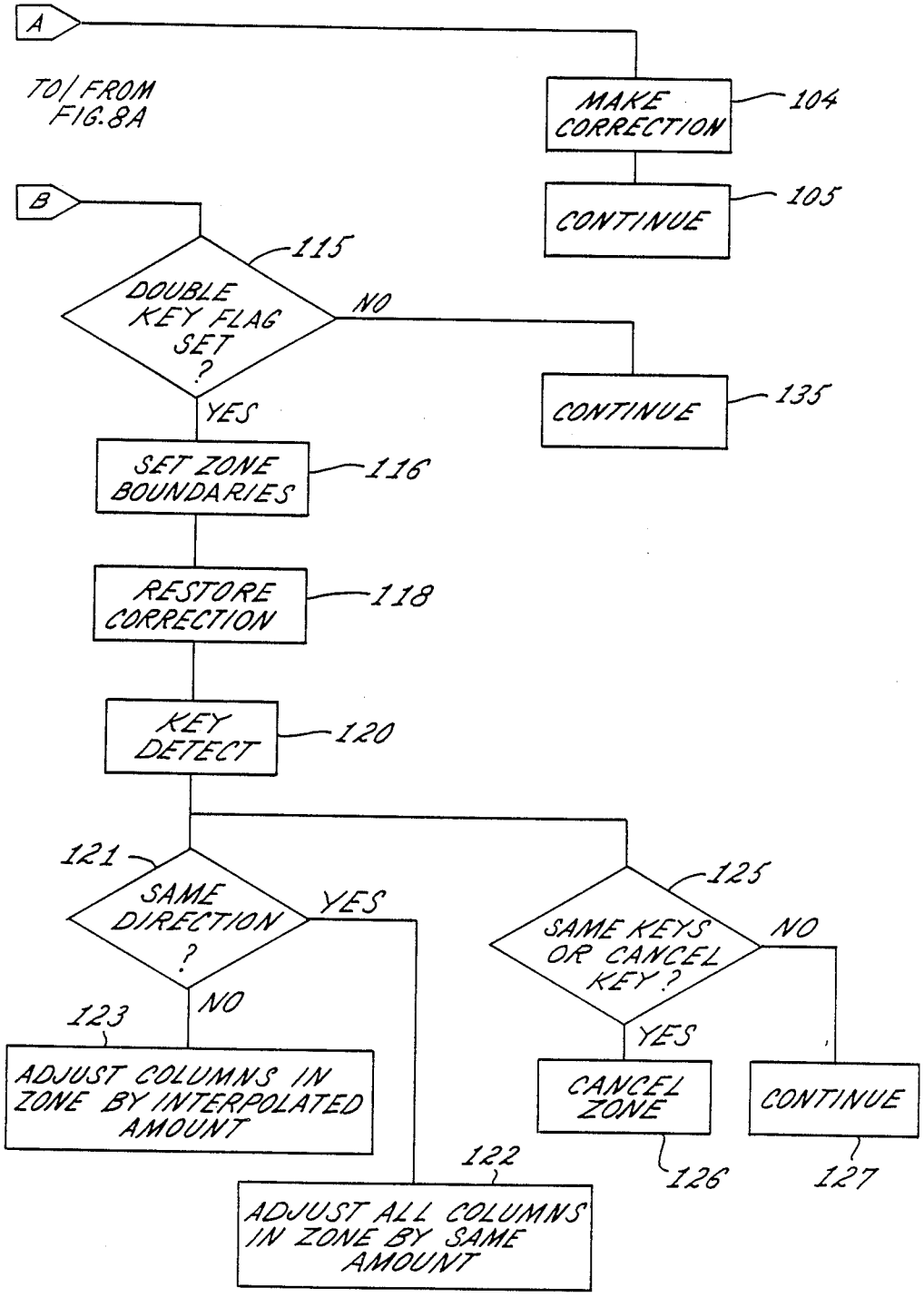

The functions assigned to the processor 50 are implemented by means of program steps stored in a program memory 51. Preferably, the program memory 51 is a read-only memory (ROM) but in some applications the program memory can also be implemented as a section of read/write memory 56. In either event, the program memory 51 contains a program of steps which produce the functions described generally above and which will be additionally described in connection with FIGS. 9A–9B (hereinafter FIG. 9).

FIG. 9 illustrates a sequence of steps for use in a control system of conventional two-keys-per-one-bidirectional-adjuster operation to allow zonal adjustment as described above utilizing the same keys and same adjusters normally used on a one-per-basis. The flowchart of FIG. 9 begins its sequence with a key detect step 100 during which the control circuit determines that one of the keys on the control panel 1 has been actuated. After detection of the actuated key, a step 101 is performed to initiate a corresponding key timer to start a first predetermined time interval. Whenever a key is depressed and its associated timer is initiated, a step 102 is performed to test other timers to determine whether another key has previously been depressed. Thus, the test of timers in the step 102 results in a test 103 to determine if the key just detected is the first key depressed. If it is, i.e., if there has been only one key actuated, the test 103 produces a positive result, and a step 104 is performed to make the associated correction in the standard manner. The program then continues at 105 to test for additional keys in the normal manner.

Assuming a key has been detected and the test of other timers at step 102 determines in the test 103 that the key just detected is not the first key depressed, a further test 106 is performed to determine if the key just detected, i.e., the new key, is in the same pair as the previously detected key. If it is, the system determines that a zone selection operation has been initiated, and proceeds to a test 108 to store the double key indicator and also to set a flag indicating that a double key operation has been detected. The sequence then continues to a step 109 which initiates the double key timer, the timer which sets the second predetermined interval discussed above. Assuming the double key timer has just been set, a further test 110, which monitors the double key timer, will test negative, following which the program will continue at step 111 to test for additional key actuations. Such actuation will again be detected in step 100 and the sequence will continue through the negative branch of the test 103 to the test 106.

Under the conditions assumed, the additional key detected (the key which is intended to define the second boundary of the zone), will not be in the same pair as the original key, and the test 106 will give a negative result. Thus, the program will branch to a further test 115 to determine if the double key flag had been set. Recalling that the flag had been set in the step 109, the test 115 will test positive causing the program to branch to a step 116 to set zone boundaries. Thus, the zone definition step described above will be performed in which the boundaries of the defined zone are set to correspond to the adjusters associated with a double key on the one side and the additional key on the other. An optional step 118 is included in the program following the step 116. Recalling that if the adjusters had been operated during the zone selection and definition operation, the step 118 is performed to restore the adjusters to their initial position. Following that step, the system awaits a further key depression at the step 120 and when a further key or keys are detected in the step 120, a zone adjustment is made. A test 121 is performed to determine if the keys which are depressed are both positive or both negative, i.e., are both in the same direction. If they are, the test 121 produces a positive result to branch the program to a step 122 which will adjust all of the columns (or adjusters) in the defined zone by the same amount and in the same direction. If, on the other hand, the keys which were detected in step 120 are not in the same direction, i.e., one is an increase key and the other is a decrease key, the test 121 will produce a negative result and cause the program to branch to a step 123. In the step 123, an adjustment is made in which the adjusters associated with the boundaries of the zone are adjusted in magnitude and direction in accordance with the key depressions, and the intermediate adjusters are interpolated between those values. If only a single key is detected in the step 120, the test 121 will also provide a negative result, and will also branch to the step 123 which will also interpolate the key adjustments, but in this case between a maximum adjustment for the adjuster corresponding with the depressed key, and zero adjustment at the boundary for which no key has been depressed.

It is recalled that after zone boundaries have been defined it is possible to cancel a zone, and such cancellation is also accomplished by detecting appropriate keystrokes in the step 120. If in the step 120 both keys in a pair at one or the other of the boundaries are detected in a step 125 (or alternatively if an auxiliary cancel key is depressed), the test 125 produces a positive result and branches to an operation 126 which serves to cancel the zone, both from the memory and from the display. If keys are detected which do not produce a cancel result as determined by the test 125, that test branches to a step 127 which simply continues the operation of the sequence.

It is recalled that is also possible to disable an adjuster by a double key operation, and that function is also determined by sequencing through the earlier steps to detect a double key operation in a step 106, to store the double key and flag in the step 108 and to initiate the double key timer in a step 109. However, when it is desired to disable the function, no new key is activated during that predetermined time interval, and the double key timer which is initiated in step 109 ultimately times out following which the test 110 will test positive, causing the program to branch to an operation 130 which will disable the adjuster in question.

It is possible for an operator to activate two keys in sequence, but to fail to begin a zone selection operation if the two keys are not those in a pair. That operation is also detected according to the sequence of FIG. 9. More particularly, the first key is detected as originally described, and the second key depressed is detected by a negative result of test 103. Thus, the program branches to a step 106, but instead of producing a positive result in that test, a negative result is produced. However, in that case the double key flag had not been set, so the test 115 also produces a negative result and simply branches the program to a step 135 which continues with the normal operation. All that will occur in that case is the corrections contemplated on a one-to-one basis by steps 104 and 105, and that no zonal selection or definition will be inadvertently established by activation of keys within a short time interval of each other, so long as those keys relate to different adjusters along the fountain.

It will now be apparent that what has been provided is an improved zonal adjustment system for fountain adjustments in a printing press. A control panel of conventional configuration can be used since it requires no additional keys, or a slight modification can be provided to simply provide an additional zonal display. The keys can be operated in the normal manner for one-to-one operation of the adjusters. However, in accordance with the invention, upon depression of particular patterns of keys, zonal operation is established such that the operator has the flexibility for rapid adjustment of many keys without further complication of the control panel.

What is claimed is:

1. A system for controlling fountain adjustments in a printing press, the press having a plurality of adjusters disposed along the fountain for making incremental adjustments across the fountain, the system comprising the combination of:

a control panel having a plurality of keys arranged in pairs related to the respective adjusters for bidirectional control of the associated adjuster;

zone selection means for detecting actuation within a predetermined time interval of both keys in a pair and as a result thereof initiating a zone selection operation;

zone definition means for detecting the actuation of a further key during a zone selection operation and defining zone boundaries as the adjusters corresponding to the actuated key pair and the further actuated key; and zone adjustment means responsive to actuation of at least one key in the zone for adjusting all of the adjusters in the defined zone.

2. The system as set forth in claim 1 in which the zone selection means includes timing means for setting the predetermined interval during which both keys in a pair must be actuated in order to initiate the zone selection operation.

3. The system as set forth in claim 2 in which the zone definition means includes second timing means for setting a second predetermined interval following the initiation of a zone selection operation during which the further key must be actuated in order to define the zone boundaries.

4. The system as set forth in claim 2 in which the system further comprises a key state memory for storing information related to the status of each of the keys; and timer memory means for determining when the keys in a pair are actuated within the predetermined time interval.

5. The system as set forth in claim 1 in which the zone definition means further includes zone cancellation means for detecting a zone cancellation signal and cancelling the defined zone.

6. The system as set forth in claim 4 wherein the zone cancellation means includes means responsive to actuation of at least said key pair for producing the zone cancellation signal.

7. The system as set forth in claim 1 wherein the keys are a plurality of mechanical switches, and the means for detecting actuation of said keys is responsive to the release of the mechanical switches.

8. The system as set forth in claim 1 in which the adjusters are operated in response to actuation of the associated key in the direction determined by the actuated key, and means are associated with the zone definition means for cancelling any adjustment made as a result of key actuations in defining a zone.

9. The system as set forth in claim 1 in which the zone adjustment means responds to actuation of two keys in the defined zone related to adjustment in the same direction by adjusting all of the adjusters in the zone in the sam direction by the same amount.

10. The system as set forth in claim 1 in which the zone adjustment means responds to actuation of two keys at the respective ends of the defined zone related to different directions by adjusting the adjusters associated with the ends of the defined zone in the directions associated with the actuated keys and by interpolating the amount and direction of adjustment for the intermediate adjusters in the zone.

11. The system as set forth in claim 1 in which the zone adjustment means responds to actuation of one key in the defined zone related to adjustment in a given direction by adjusting the adjuster related to the actuated key by a given amount and adjusting all other adjusters in the defined zone by amounts interpolated from the actuated key.

12. The system as set forth in claim 1 in which the zone definition means further comprises means for setting a second predetermined interval during which the further key must be actuated in order to define the zone; and adjuster deactivation means responsive to the expiration of said predetermined time interval for deactivating the adjuster associated with the actuated key pair.

13. The system as set forth in claim 1 in which the keys in a pair are juxtaposed for simultaneous actuation by a single finger.

14. The system as set forth in claim 13 in which the keys have contoured key tops with a finger receiving contour joining the two keys where said keys in a pair are juxtaposed.

15. The system as set forth in claim 1 in which the fountain adjustments comprise ink feed adjustments across an ink fountain in a printing press.

16. The system as set forth in claim 1 in which the fountain adjustments comprise dampener adjustments across a dampener fountain in a printing press.

17. A method for controlling fountain adjustments in a printing press, the press having a plurality of fountain adjusters displaced across the fountain for making incremental fountain adjustments, the press also having a control panel with a plurality of keys associated with the adjusters, the keys being disposed in pairs for controlling two directions of bi-directional control of the adjusters, the method comprising the steps of:

(a) detecting the actuation of any key and adjusting the associated adjuster in response thereto;

(b) detecting the actuation of both keys in a pair within a predetermined time interval and establishing a zone selection operation in response to said detection;

(c) detecting actuation of a further key during a zone selection operation and defining a zone having boundaries corresponding to the actuated key pair and to the further key; and (d) detecting actuation of at least one key in the zone after a zone definition and adjusting all of the adjusters in the defined zone in response to said key detection.

18. The method as set forth in claim 17 further comprising the step of initiating a predetermined time interval during said zone selection operation, and defining the zone only if the actuation of said further key is detected during said predetermined time interval.

19. The method as set forth in claim 18 further including the step of deactivating the adjuster means associated with the actuated key pair if actuation of said further key is not detected during the predetermined time interval.

20. The method as set forth in claim 17 in which the method, after defining a zone, further includes the step of cancelling the defined zone in response to actuation of at least a key pair defining one of said zone boundaries.

21. The method as set forth in claim 17 in which the method, after defining a zone, further includes the step of cancelling any adjustment made in response to detection of actuation of a key during the zone selection or definition operations.

22. The method as set forth in claim 17 in which step (d) further comprises detecting actuation of two keys in the defined zone related to in the same direction and, in response thereto, adjusting all of the adjusters in the zone in the same direction by the same amount.

23. The method as set forth in claim 17 in which the step (d) further comprises detecting actuation of two keys at the respective ends of the defined zone related to different directions and, in response thereto, adjusting the adjusters associated with the ends of the defined zone in the directions associated with the actuated keys and interpolating the amount and direction of adjustment for all the intermediate adjusters in the defined zone.

24. The method as set forth in claim 17 in which the step (d) further includes detecting the actuation of one key in the defined zone related to adjustment in a given direction, and, in response thereto, adjusting the adjuster related to the actuated key by a given amount and adjusting all other adjusters in the defined zone by amounts interpolated from the actuated key.

* * * * *